US005727467A

United States Patent [19]

Skopek

[11] Patent Number: 5,727,467

[45] Date of Patent: Mar. 17, 1998

[54] HAND STAMP

[75] Inventor: Karl Skopek, Thalheim bei Wels, Austria

[73] Assignee: Colop Stempelerzeugung Skopek GmbH & Co. KG, Wels, Austria

[21] Appl. No.: 763,191

[22] Filed: Dec. 10, 1996

[30] Foreign Application Priority Data

Jan. 4, 1996 [AT] Austria ..... GM 4/96

[51] Int. Cl.[6] ..... B41K 1/00; B41K 1/36

[52] U.S. Cl. ..... 101/334; 101/104

[58] Field of Search ..... 101/334, 104, 101/105

[56] References Cited

U.S. PATENT DOCUMENTS

| | | | |
|---|---|---|---|
| 973,556 | 10/1910 | Peterson | 101/334 |
| 1,219,383 | 3/1917 | Ellis | 101/334 |
| 1,345,255 | 6/1920 | Rushworth | 101/334 |
| 2,312,727 | 3/1943 | Nisenson | 101/334 |
| 2,829,594 | 4/1958 | Goc | 101/334 |
| 4,823,696 | 4/1989 | Skopek | 101/334 |
| 5,058,501 | 10/1991 | Skopek | 101/334 |

FOREIGN PATENT DOCUMENTS 1 113 221 8/1961 Germany .

*Primary Examiner*—Edgar S. Burr
*Assistant Examiner*—Amanda B. Sandusky
*Attorney, Agent, or Firm*—Collard & Roe, P.C.

[57] ABSTRACT

A hand stamp has a housing and an actuating yoke extending over the housing and displaceable against a spring force, which actuating yoke has legs guided on the side walls of the housing, at least one horizontally displaceable latching element being provided in one of the legs and having the form of a resilient tongue engageable in a latching recess, which latching recess is arranged on the adjacent side wall of the housing and is provided with an undercut portion at its upper rim, and the free end of the tongue can be hooked behind this undercut portion.

12 Claims, 2 Drawing Sheets

HAND STAMP

FIELD OF THE INVENTION

The invention relates to a hand stamp comprising a housing and a printing character actuating yoke that extends over the housing and is displaceable against the force of a spring; the actuating yoke has legs guided on side walls of the housing, as well as at least one latching element horizontally shiftably located in one of the legs of the actuating yoke, which latching element is engageable in at least one latching recess provided on an adjacent side wall of the housing so as to releasably lock the actuating yoke in a predetermined position of its displacement path along the housing.

BACKGROUND OF THE INVENTION

From U.S. Pat. No. 4,823,696 A as well as from U.S. Pat. No. 5,058,501 A, hand stamps are known which comprise a self-inking device for a printing character unit movably mounted in a housing as well as an inverting or reversing mechanism for this unit. To move the printing character unit into the stamping position when using the hand stamp, the unit is shifted and concurrently rotated by 180° by aid of the inverting mechanism. An actuating yoke which, in these known hand stamps, is connected with a hollow handle serves as a manipulating device therefor, a sleeve connected to the stamp housing being arranged within the handle, with a spring being interposed therebetween. To fix the stamp in different positions, i.e. to lock the actuating yoke relative to the housing, an inwardly shiftable locking bar is mounted on the handle, which locking bar is engageable in one of several latching notches on the inner sleeve. In this manner, e.g., ink can be refilled in a fixed intermediate position, or a change of the displaceable printing characters, e.g., in the form of type bands, can be effected. To lock or release the actuating yoke in this instance, it is, however, necessary to hold the stamp in one hand and to shift the locking bar with the other hand.

Furthermore, a hand stamp is commercially available which constitutes a further development of the above-explained hand stamp in so far as the upper transverse portion of the actuating yoke itself forms the manipulating handle device. Accordingly, the latching element provided for fixing various stamp positions is also designed as a horizontally shiftable locking bar, yet there, the locking bar is arranged on one of the legs of the actuating yoke. In detail, this locking bar can be pressed, in a direction perpendicular to the adjacent side wall of the housing, into one of several latching recesses in the side wall of the housing, the lower rim of the latching recesses being designed as an inclined outwardly extending return surface to guide the locking bar outwardly again when the actuating yoke is moved further down on the housing. To release the actuating yoke, the latter is simply pressed downwardly so that the locking bar slides outwardly along the inclined surface of the latching recess, whereby the actuating yoke is freely shiftable again.

The hand stamp described i. a. has, however, the inherent disadvantage that, due to the spring acting between the actuating yoke and the housing, a lateral force occurs via the locking bar arranged on one side, which lateral force may lead to a jamming of the legs of the actuating yoke on the side walls of the housing when the locking bar is released. Above all, however, it is disadvantageous that the locking bar designed as a slide is a separate construction part which has to be produced separately and for which a separate bearing must be provided on the actuating yoke.

SUMMARY OF THE INVENTION

It is thus an object of the invention to provide a hand stamp of the initially defined type whose latching device is simple in terms of structure, production and assembly. It is another object of the invention to provide a hand stamp which is easy to be actuated by one hand, and in which the leg of the actuating yoke does not get jammed on the side walls of the housing.

According to the invention, the hand stamp of the initially defined type comprises the important features that at its upper rim, the latching recess is provided with an undercut portion and that the latching element is formed by a resilient tongue whose free end can be pressed into the latching recess and can be hooked behind the undercut portion. By this solution, a separate, displaceably mounted latching part for locking or releasing the actuating yoke can be avoided in an advantageous manner; rather, the resilient tongue is fixedly connected to the leg of the actuating yoke, thus greatly simplifying production and assembly. By the undercut portion of the latching recess, safe hooking-in of the tongue is ensured irrespective of its elasticity.

It is particularly advantageous if the tongue is arranged in an opening of the leg of the actuating yoke, whereby the tongue can be housed within the contour of the leg of the actuating yoke, protected from possible damage and optically unobtrusive.

Furthermore, it is advantageous if the tongue is integrally moulded to the leg of the actuating yoke in the opening. By this measure, an integral one-piece structure of the latching element on the actuating yoke is achieved in a particularly simple manner.

To avoid jamming of the legs of the actuating yoke on the side walls of the housing in a particularly effective manner, a respective tongue may be arranged in each of the two legs of the actuating yoke. Two-sided latching or arresting obtainable thereby can be accomplished also with one hand without any problems, because resilient tongues are provided as the latching elements.

Furthermore, it is suitable if the tongue, in its at-rest position, is located within the boundaries defined by the wall thickness of the leg of the actuating yoke, whereby it is ensured that the free end of the tongue, in its at-rest position, cannot unintentionally come into engagement with the undercut portion of the respective latching recess.

To facilitate hooking-in of the free end of the tongue behind the Undercut portion of the latching recess, the free end of the tongue may be designed to taper to a tip. This furthermore results in an exact fit of the free end of the tongue within the undercut portion.

For a simple actuation of the tongue during latching, the tongue may be configured with a thickened portion adjacent its free end as well as with a connecting portion of relatively slighter thickness, the thickened portion acting as a manipulating means. The relatively thin configuration of the connecting portion by which the connection to the leg of the actuating yoke is realized simultaneously ensures the resilience of the tongue in a simple manner.

In this context it is also suitable with a view to simple and safe handling or actuation of the latching device, if the outer side of the tongue, starting from the tipped free end, is designed as a convex pushbutton.

The inner surface of the tongue facing the side wall of the housing may extend inclinedly outwardly and upwardly under an acute angle, e.g. by 1° to 5°, preferably approximately 3°, to the plane of the inner side of the leg of the actuating yoke. In this manner it is additionally ensured that the free end of the tongue in the at-rest position thereof cannot inadvertently come into engagement with the undercut portion of the latching recess. Moreover, the distance of resilient movement is lengthened thereby, and thus the resilience or the return force of the tongue, respectively, is increased in a favorable manner, so it is even more assured that the tongue will spring back into its at-rest position when released from the undercut portion.

Preferably, the opening and the tongue have generally rectangular configuration, seen in a plan view. This enables a compact configuration of the tongue, which furthermore can offer a sufficiently large pressing surface for the pressing-in action.

For dimensioning the resilience of the tongue it has proved suitable if the connecting portion of the tongue has approximately half the thickness of the thickened portion which is designed as a push-button.

BRIEF DESCRIPTION OF THE DRAWINGS

In the following, the invention will be explained in greater detail by way of particularly preferred exemplary embodiments which are illustrated in the drawings, to which, however, it shall not be restricted. In the drawings.

DETAILED DESCRIPTION OF THE INVENTION

Figure 2:
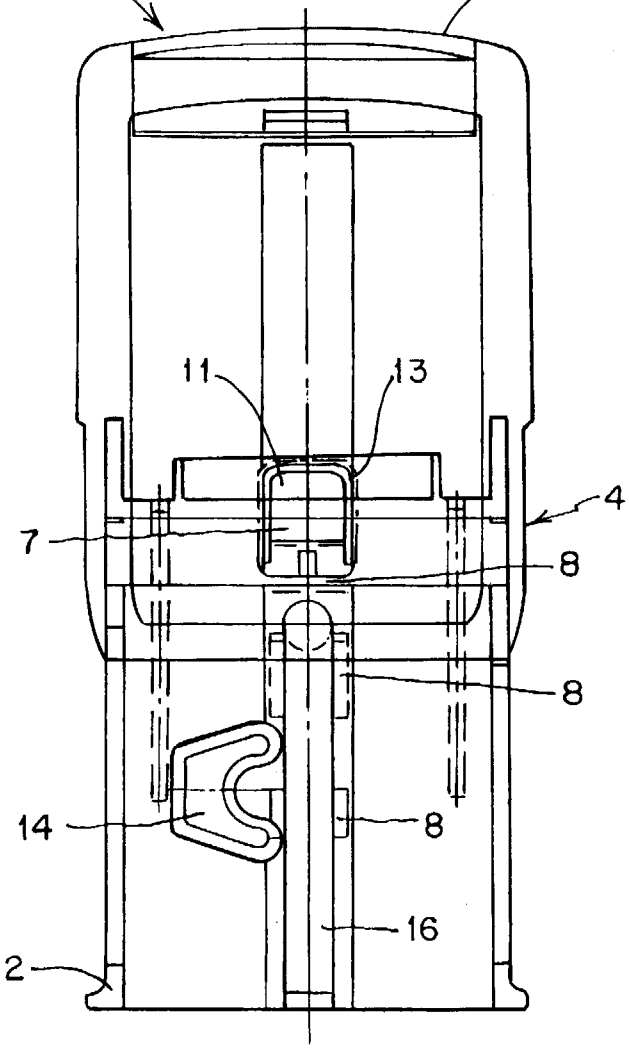
FIG. 2 is a side view of the hand stamp according to FIG. 1.
Figure 1:
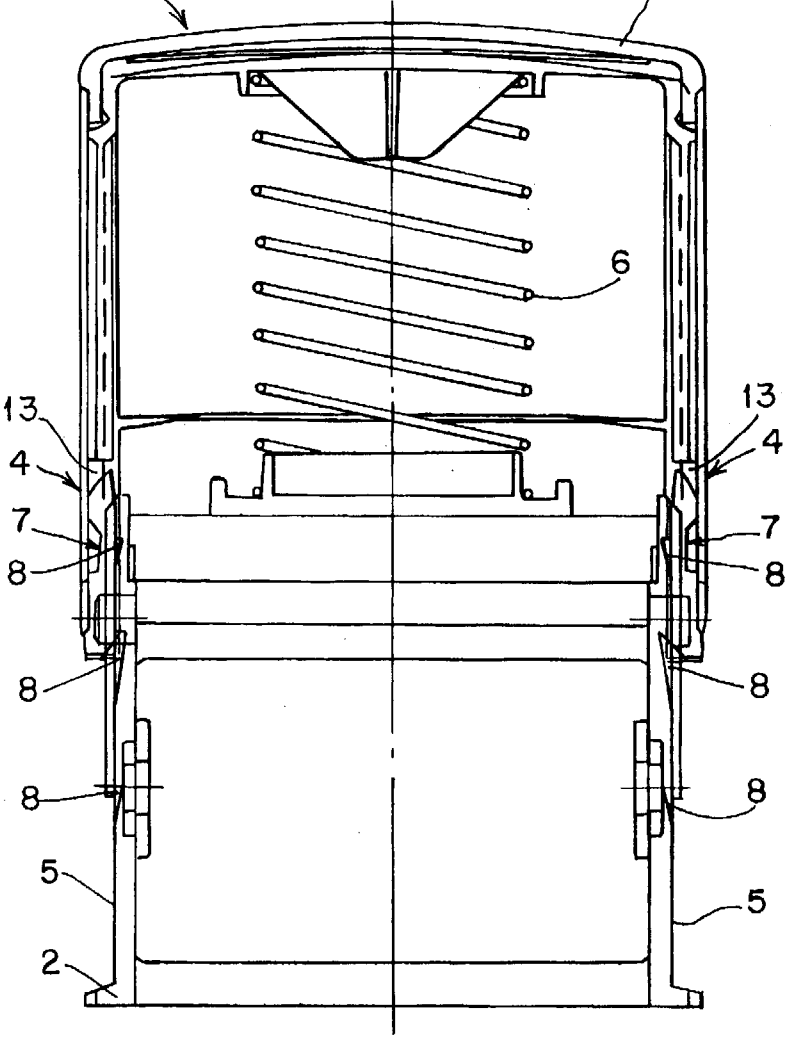
FIG. 1 shows a front view of a hand stamp, the stamp housing being illustrated in thick lines and the actuating yoke being illustrated in thin lines.
Figure 3:
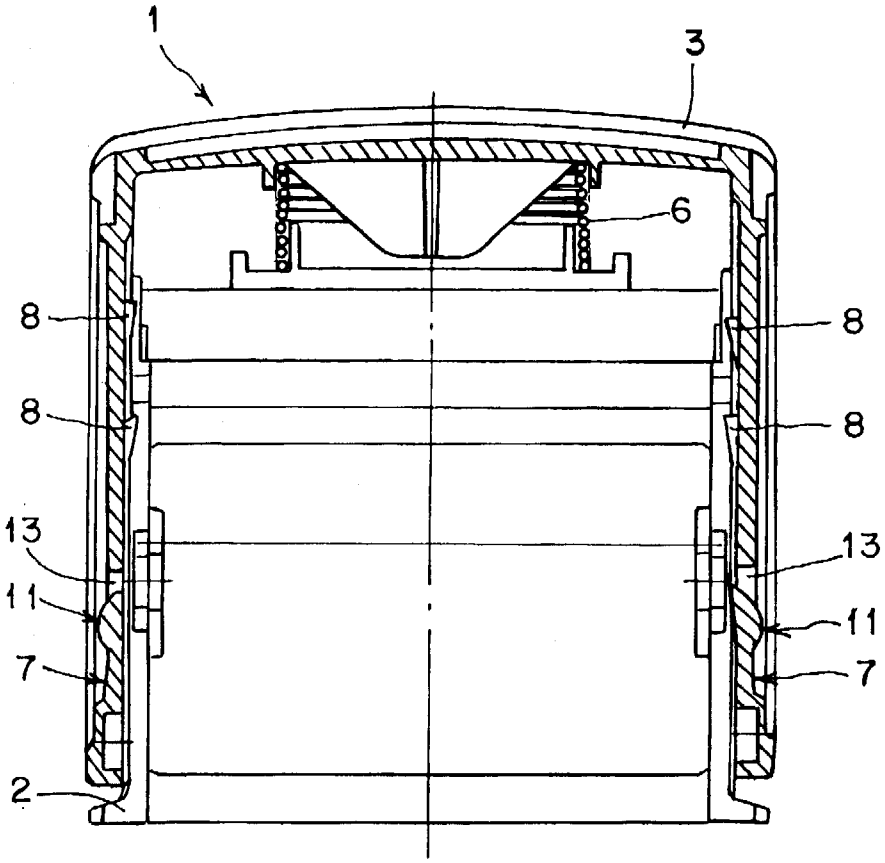
FIG. 3 is a front view of the hand stamp of FIGS. 1 and 2, partly in section, the actuating yoke being latched with the housing in a lower position.

In FIGS. 1 to 3, a hand stamp generally denoted by 1 is shown, this hand stamp 1 being considered at least at present as most preferred embodiment. The hand stamp 1 comprises a housing 2 and an actuating yoke 3 which extends over the housing 2 and whose two legs 4 are displaceably mounted on the two side walls 5 of the frame-like housing 2 against the force of a spring 6. The spring 6 is supported by the housing 2, on the one hand, and by the yoke 3, on the other hand. By aid of the actuating yoke 3, a printing character unit is moved, in a known manner, from an upper at-rest position into a lower operating position and is also inverted by 180° when using the stamp 1. For reasons of clarity, the parts constituting the inverting mechanism of this hand stamp, such as character wheels, character bands, printing plate, self-inking pad etc., have been omitted, which parts are known per se and do not require any further explanation. For details, cf. e.g. U.S. Pat. No. 4,823,696 A or U.S. Pat. No. 5,058,501 A.

To arrest the actuating yoke 3 at different levels of its displacement path on the housing 2 for the purpose of adjusting the character wheels, refilling the ink pad or arresting in the at-rest or operating positions, latch elements in the form of resilient tongues 7 are arranged in the legs 4 of the actuating yoke 3. As will be explained in more detail, each of these tongues 7 can be pressed into latching recesses 8 in the associated side wall 5 of the housing 2, and their configuration can best be seen in the enlarged representation according to FIG. 4, which shows a tongue 7 in the at-rest position. The free end 9 of the tongue 7 tapers upwardly and continuously merges downwardly into a thickened portion 10 serving as a manipulating means designed as a convex push-button 11, compare also FIG. 2. A lower connecting portion 12 following upon the thickened portion 10 has approximately half the thickness of the thickened portion 10 to enable a resilient bending of the tongue 7.

The tongue 7 is arranged in a passage opening 13 in the leg 4, and its lower end is integrally moulded to the leg 4. The actuating yoke 3 and thus also the tongue 7 are produced from a suitable synthetic material, preferably ABS, by pressure casting or by injection moulding. In principle, it would also be possible to design the tongue 7 as a metallic leaf spring with a push button, which is attached on the leg 4 in the passage opening 13 in a suitable manner, e.g. inserted into a slot, glued and so on.

As is apparent from FIG. 2, the opening 13 and the tongue 7 located therein and dimensioned somewhat smaller have generally rectangular shape. In FIG. 2, an opening in the side wall 5 of the housing 2 is denoted by 14, which serves as a guide slot for the inverting mechanism of the hand stamp 1 which is known per se, and need not be explained in detail here.

Figure 4:
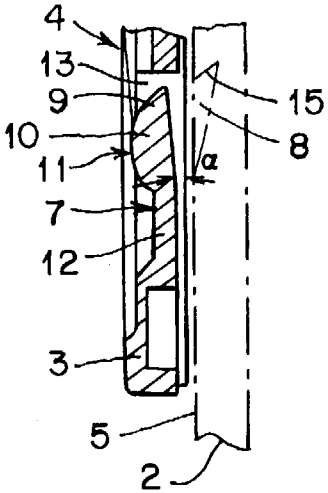
FIG. 4 is an enlarged detail of the latching means of this hand stamp, in cross-section.

According to FIG. 4, the above-mentioned latching recess 8 in the side wall 5 of the housing 2 (illustrated in dot-and-dash lines in FIG. 4) is designed to extend upwardly with an inward inclination and is provided with an undercut portion 15 whose shape is adapted to the tip 9 of the tongue 7.

In the exemplary embodiment illustrated, three latching recesses 8 are each arranged in the middle of the side walls 5, opposite the tongues 7, at different levels (cf. FIGS. 1 to 3). As is particularly apparent from FIG. 2, the latching recesses 8 may also be discontinuous, i.e. they may be formed by two recess parts on both sides of a central vertical longitudinal slot 16 in the respective housing side wall 5; in this case, the longitudinal slots 16 serve for guiding a printing character axle in a known manner.

From the at-rest position of the tongue 7 illustrated in FIG. 4 it is furthermore apparent that the latter is located within the boundaries defined by the wall thickness of the leg 4, and that the inner face of the tongue 7 facing the neighbouring side wall 5 of the housing 2 extends upwardly and inclinedly outwardly under an acute angle $\alpha$, e.g., by 1° to 5°, preferably by approximately 3°, to the plane of the inner side of the leg 4.

Figure 5:
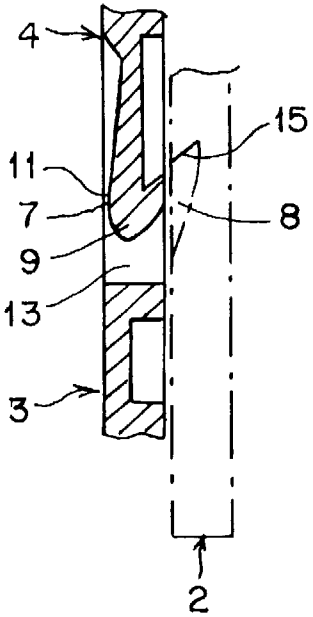
FIG. 5 is an illustration according to FIG. 4, but of a modified latching means.

FIG. 5 shows a modification of the latching means, in which the free end 9 of the tongue 7 is hook-shaped, and in which the tongue 7 is integrally connected with the leg 4 of the actuating yoke 3 at its upper end, instead of at its lower end, as illustrated in FIG. 4. In this case, a thickened material region adjacent the hook-shaped end 7 again forms a push-button 11.

From the uppermost, unlatched position illustrated in FIG. 1, the actuating yoke 3 may be shifted downwardly by hand, against the force of the spring 6, until it has reached the desired position, with the tongues 7 at one of the three latching recesses 8. Then the tongues 7, i.e. the push-buttons 11, on both sides of the stamp 1, are pressed inwards by means of thumb and index finger or ring finger, so that the free ends 9 of the tongues 7 pivot into the respective latching recess 8. If then the manual pressure on the actuating yoke 3 is somewhat alleviated while simultaneously maintaining the pressure applied to the push buttons 11, the actuating yoke 3 is shifted upward by the force of the spring 6 until the tipped free ends 9 of the tongue 7 are completely hooked into the undercut portion 15 of the latching recesses 8, so that the actuating yoke 3 is latched in (cf. e.g., the lower latching position in FIG. 3). This equally applies to the embodiments according to FIGS. 4 and 5. The only difference between these embodiments is that in the embodiment according to FIG. 4, the tongue 7 is pressure-loaded by the spring 6 in the longitudinal direction in the latched position, in the embodiment according to FIG. 5, however, the tongue is loaded by tensile stress.

To release the latching again, the actuating yoke 3 need only be pressed downwardly relative to the housing 2 until the free ends 9 of the tongues 7, due to the inherent resilience of the tongues 7 as well as optionally due to the slide guide along the inclined inner faces of the latching recesses 8 spring back outwardly, past the upper undercut edge of the latching recesses 8, into the at-rest position, so that the actuating yoke 3 is again freely shiftable.

What is claimed is:

1. A hand stamp comprising a housing having side walls, a printing-character actuating yoke including legs and extending over said housing and displaceable against a spring force, said legs of said actuating yoke being guided on said side walls of said housing, and at least one latching element horizontally displaceably arranged in one of said legs of said actuating yoke, at least one latching recess being provided in the adjacent side wall of said housing, said at least one latching element being engageable in said at least one latching recess so as to latch said actuating yoke in pre-determined positions of its displacement path along said housing, said at least one latching recess including an undercut portion at its upper rim and said at least one latching element being formed by a resilient tongue having a free end capable of being pressed into said at least one latching recess and being hooked behind said undercut portion of said at least one latching recess.

2. A hand stamp as set forth in claim 1, wherein said leg of said actuating yoke has an opening and said tongue is arranged in said opening.

3. A hand stamp as set forth in claim 2, wherein said tongue is integrally moulded to said leg of said actuating yoke in said opening.

4. A hand stamp as set forth in claim 1, wherein a tongue is arranged in each of said legs of said actuating yoke.

5. A hand stamp as set forth in claim 1, wherein said tongue, in its at-rest position, is located within boundaries defined by the wall thickness of the leg of said actuating yoke.

6. A hand stamp as set forth in claim 1, wherein the free end of said tongue tapers to a tip.

7. A hand stamp as set froth in claim 3, wherein said tongue includes a thickened portion adjacent its free end as well as a connecting portion of relatively slighter thickness, said thickened portion serving as a manipulating means.

8. A hand stamp as set forth in claim 7, wherein said tongue has an outer side, said outer side starting from the tipped free end of the tongue being designed as a convex push-button.

9. A hand stamp as set forth in claim 1, wherein said leg of said actuating yoke has an inner side extending in a plane, and said tongue has a tongue inner surface facing said side wall of said housing, said tongue inner surface extending inclinedly outwardly and upwardly under an acute angle ($\alpha$) of from 1° to 5° relative to said plane.

10. A hand stamp as set forth in claim 9, wherein said acute angle is an angle of approximately 3°.

11. A hand stamp as set forth in claim 3, wherein said opening and said tongue are generally rectangular in plan view.

12. A hand stamp as set forth in claim 8, wherein said connecting portion of said tongue is approximately half as thick as said thickened portion.

* * * * *